US005174386A

United States Patent [19]

Crover

[11] Patent Number: 5,174,386

[45] Date of Patent: Dec. 29, 1992

[54] GROUND ROD DRIVING APPARATUS

[75] Inventor: Stephen E. Crover, Borine, Oreg.

[73] Assignee: The Stanley Works, New Britain, Conn.

[21] Appl. No.: 771,646

[22] Filed: Oct. 4, 1991

[51] Int. Cl.[5] ..... E02D 7/02

[52] U.S. Cl. ..... 173/53; 173/129; 173/132

[58] Field of Search ..... 173/129, 132, 92, 14, 173/53, 55

[56] References Cited

U.S. PATENT DOCUMENTS

| | | | |
|---|---|---|---|
| 1,604,958 | 11/1926 | Bayles | 173/132 X |
| 2,693,086 | 11/1954 | Caruthers | 173/132 X |
| 2,802,340 | 8/1957 | Tallman | 173/132 X |
| 3,454,113 | 7/1969 | Holtz | 173/120 |
| 4,160,486 | 7/1979 | Kostylev et al. | 173/135 |
| 4,205,727 | 6/1980 | Smolyanitsky et al. | 173/55 |
| 4,298,074 | 11/1981 | Mattchen | 173/129 |
| 4,487,273 | 12/1984 | Smolyanitsky et al. | 173/55 |
| 4,516,662 | 5/1985 | Kostylev et al. | 173/53 |
| 4,776,407 | 10/1988 | Kostylev et al. | 173/55 |
| 5,010,710 | 4/1991 | Gray et al. | 173/90 X |

FOREIGN PATENT DOCUMENTS

| | | | |
|---|---|---|---|
| 3026861 | 2/1982 | Fed. Rep. of Germany | 173/53 |

*Primary Examiner*—Douglas D. Watts

*Assistant Examiner*—Rinaldi Rada

[57] ABSTRACT

A ground rod driver has a housing with upper and lower ends, and inlets and outlets for hydraulic fluid. A check assembly in the housing adjacent its lower end includes a chuck with a central bore and a multiplicity of chuck jaws slidably seated in the bore and providing spaced apart faces defining a passage therebetween. The chuck bore and the outer surfaces of said jaws have cooperating downwardly converging configurations to provide a wedging action upon relative movement of said jaws into the bore. A drive assembly effects relative movement of the jaws and the chuck bore to move the jaws inwardly of the bore to effect clamping of the ground rod and to move the jaws outwardly of the bore to release the ground rod. An anvil above the clutch assembly abuts the chuck jaws, and a drive piston assembly includes a reciprocatable hollow drive piston for impacting upon the anvil. A valve controls the flow of hydraulic fluid to effect reciprocation of the drive piston to impact upon the anvil. A ground rod may be passed through aligned passages in the housing, piston assembly, anvil and chuck assembly, and actuation of the drive assembly clamps the ground rod in the chuck jaws. The drive piston is reciprocated to impact upon the anvil and thereby the chuck jaws to drive the ground rod into the ground while it remains continuously and fimly gripped in the chuck jaws.

26 Claims, 8 Drawing Sheets

GROUND ROD DRIVING APPARATUS

BACKGROUND OF THE INVENTION

The present invention relates to hydraulic apparatus for driving rods and the like into the ground.

It is well known that it is desirable to provide ground rods along electrical transmission lines and adjacent other poles and elevated towers so as to provide a good ground connection for a ground wire from the structure with which they are associated. Although it is possible to drive such rods into the ground by hand using a mallet or the like, frequently the desired length of the rods will require the workman to stand upon a platform or the like in order to be able to strike the upper end of the rod. As a result, long rods are frequently driven into the ground by use of a pavement breaker or the like operated from an elevated platform or hanging from a boom or a crane.

However, more recently, manually held apparatus has been proposed to drive elongated rods into the ground, and this apparatus may be operated with the operator standing on the ground. In such apparatus, the rod extends through a central passage in the hydraulic driver, and the rod is repositioned as it is being driven into the ground. Exemplary of such devices are those illustrated in Smolyanitski et al U.S. Pat. Nos. 4,205,727 and 4,487,273 and Kostylev et al U.S. Pat. Nos. 4,516,662 and 4,776,407. As will be noted from a review of the structures of these patents, generally it is required that the driver be in intimate contact with the surface of the ground so that the clamping mechanism about the rod will be released during the recoil portion of the drive stroke and thereby repositioned. Moreover, devices of this type generally require serrated jaws or the like to quickly and instantaneously grip the rod during the drive portion of the stroke. Thus, they present the potential for undesirable marring of the galvanized or other protective surface provided upon the rod.

It is an object of the present invention to provide a novel ground rod driver which provides continuous firm gripping of the rod until it is released by an intentional action of the person operating the rod driver.

It is also an object to provide such a ground rod driver which firmly grips the ground rod in the jaws of a chuck assembly so as to preclude relative movement until such time as the chuck jaws are moved outwardly from gripping contact by intentional operation of the clamping mechanism.

Another object is to provide such a ground rod driver which is rugged in construction and long lived in operation.

SUMMARY OF THE INVENTION

It has now been found that the foregoing and related objects may be readily attained in a ground rod driver which includes a housing having upper and lower ends, a top cap at the upper end, and inlet and outlet for hydraulic fluid. A chuck assembly is disposed in the housing adjacent its lower end, and it includes a chuck having a central bore and a multiplicity of chuck jaws slidably seated in the central bore of the chuck with spaced apart faces defining a passage therebetween. The chuck bore and the outer surfaces of the jaws have cooperating downwardly converging configurations to provide a wedging action upon relative movement of the jaws into the bore.

Means for effecting relative movement of the jaws and the chuck bore moves the chuck jaws inwardly of the chuck bore to effect clamping of a ground rod extending through the jaws, and relative movement of the jaws outwardly of the chuck bore releases the ground rod. An anvil is disposed in the housing above the clutch assembly and abuts the chuck jaws. A drive piston assembly is disposed adjacent the upper end of the housing and it includes a reciprocatable hollow drive piston for impacting upon the anvil. Valve means is provided in the housing for effecting reciprocation of the drive piston to impact upon the anvil, and hydraulic fluid circuit means in the housing communicates with said drive piston assembly and the chuck movement means. The top cap, housing, drive piston assembly, anvil, and chuck have aligned passages therein through which the ground rod extends. The chuck movement means may be activated to clamp the ground rod, and, when the drive piston is reciprocated, it impacts upon the anvil and thereby the chuck jaws to drive the ground rod into the ground while the ground rod remains continuously and firmly gripped in the chuck jaws.

The chuck bore desirably is configured to provide a multiplicity of axially extending angled recesses and the jaws are cooperatively configured to seat in the recesses. Desirably, the recesses are of arcuate cross section about a center passage to provide a generally trilobal cross section.

In one embodiment, the jaws have a cross section which is substantially that of a truncated circle with the chordal surface providing a substantially planar clamping surface.

In the preferred embodiment, the movement means includes a compressible spring in the housing below the chuck, and it biases the chuck upwardly about the chuck jaws to effect initial clamping of the ground rod. The chuck movement means desirably includes a hydraulically actuated chuck piston to move the chuck downwardly against the biasing pressure of the spring, thereby moving the chuck jaws outwardly of the bore therein. Desirably, the housing includes a stationary guide nut at its lower end against which the chuck jaws abut to limit their downward movement with the chuck. The chuck piston is movable upwardly to allow the compression spring to bias the chuck upwardly about the chuck jaws to seat them within its bore to effect clamping action.

Desirably, the anvil is movable upwardly in the housing with the chuck jaws, and there is included a stop which limits its upward movement. As a result, the chuck jaws and anvil are movable upwardly with the chuck until the anvil abuts the stop and further upward movement of the chuck causes the chuck jaws to move inwardly of the chuck bore as the chuck continues to move upwardly.

The chuck piston is of generally annular cross section with an external shoulder upon which the hydraulic fluid acts and with a shoulder extending about its inner surface which is engageable with a circumferential shoulder on the chuck to effect the downward movement of the chuck. The compression spring bears against the lower surface of a circumferential collar providing the circumferential shoulder on the chuck. The lower end portion of the housing provides a cylinder in which the chuck piston is movable.

In operation, the impact of the drive piston upon the anvil and thereby upon the chuck jaws exerts a force driving the chuck jaws into the bore of the chuck to ensure firm engagement of the ground rod.

In the preferred embodiment, a trigger member is pivotably mounted on the top cap and it is manipulatable among multiple positions to actuate the chuck jaw movement means to clamping and releasing positions and to actuate the drive piston assembly. A slide valve in the housing is movable by the trigger member between clamping, releasing and drive positions.

As will be appreciated, the chuck jaws grip the rod with substantial frictional pressure enhanced by the wedging action within the chuck, and the downstroke of the drive piston produces an impact upon those jaws translating into increased clamping pressure. As a result, relative movement between the ground rod and the jaws is effectively precluded until the clamping action is released.

It is desirable that the protective surface coating provided on such ground rods (usually galvanized zinc or copper) be substantially undamaged during their passage through the ground rod driver. Accordingly, the contacting surfaces of the clamping jaws of the chuck should be machined and finished to minimize aberrations which would adversely affect the surface finish of the ground rod.

As will be appreciated, the design of the chuck and chuck jaws does permit a variation in the effective spacing between the opposed faces of the jaws so as to enable the device to accommodate ground rods of different sizes. This is also true with respect to the passages through the operating elements of the system which can be dimensioned sufficiently large to accommodate the desired range. In a commercial embodiment of the product of the present invention, ground rods of ½ inch, ⅝ inch and ¾ inch may be accommodated simply by changing the chuck jaws, and this change may be effected simply by removing the rod guide nut from the bottom of the cylinder, removing and replacing the chuck jaws and guide rod nut with components of the desired dimension.

In operation of the tool, the trigger lever will be moved to the release position so that the ground rod may be inserted through the driver to the desired length of extension beyond the guide nut. The length of extension will depend upon the height at which the operator may conveniently operate the driver. Upon release of the trigger lever, the mechanism of the driver will immediately clamp the ground rod at the desired extension. Generally, the amount of extension of the rod from the working end will normally be 18–30 inches and the ground rod should be repositioned before the lower end of the drive abuts the ground surface.

Under normal soil conditions, the grip of the chuck jaws on the rod will automatically tighten as impacting begins during the drive cycle. However, if the soil is particularly hard or if an obstruction is immediately encountered, it may be desirable to momentarily depress the trigger into the drive position several times to allow single hammer blows to tighten the jaw grip before actually starting to drive the rod deeply into the ground. Thus, it can be seen from the foregoing detailed description and attached drawings that the ground rod driver of the present invention is one which firmly grips the ground rod during the driving operation and until it is intentionally released. This avoids marring the surface on the ground rod, and it avoids the necessity for holding the ground rod driver against the ground surface or providing some other means to automatically reposition the ground rod after each stroke. The ground rod driver of the present invention may be fabricated from elements which are rugged and durable in construction, and it will provide long lived and relatively trouble free operation.

DETAILED DESCRIPTION OF THE PREFERRED EMBODIMENT OF THE INVENTION

In order to explain the overall operation of a ground rod driver embodying the present invention, the operation of its several modes will first be described in the normal sequence of their operation, "release" mode, "clamp" mode and "drive" mode. The operation of the automatic valve to effect reciprocation of the drive piston while the trigger is held in the "drive" position will then be described.

Figure 1:
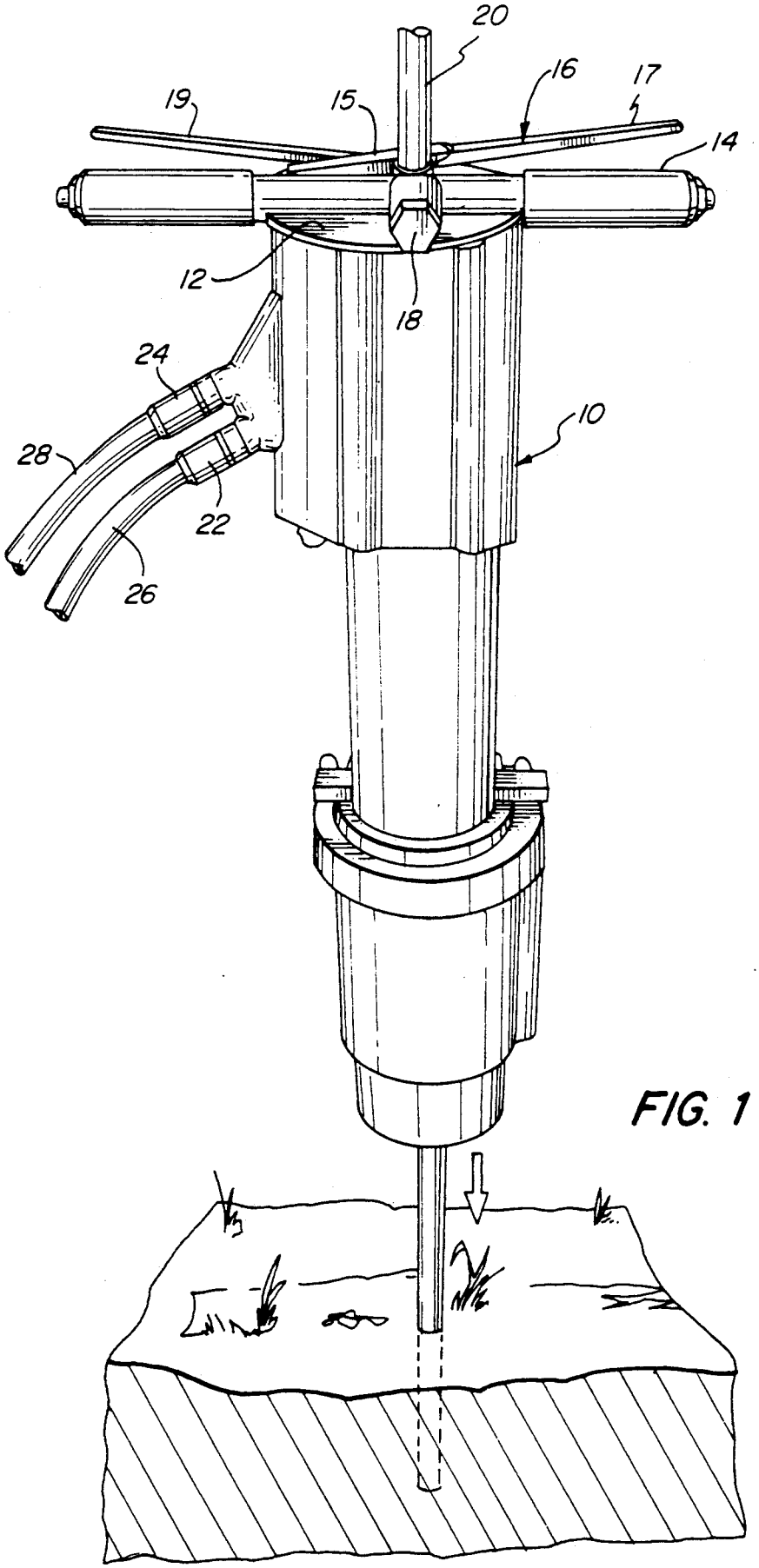
FIG. 1 is a perspective view of a ground rod driver embodying the present invention with the trigger in the "clamp" position, and the ground rod just penetrating the soil at a desired location.

Turning first to FIG. 1, a ground rod driver embodying the present invention includes a housing generally designated by the numeral 10 and a top cap 12, upon which is seated a pair of handles 14 and upon which a trigger lever generally designated by the numeral 16 is pivotably supported. Also provided in the top cap 12 is a charging port for gas used in the accumulator which is sealed by the plug 18. The trigger lever 16 has a center section 15 and a pair of elongated arms 17, 19 inclined upwardly therefrom. A ground rod 20 is fragmentarily illustrated and extends through a passage in the cap 12, through the housing 10, and outwardly from its lower end and into the ground as illustrated. The housing 10 has inlet and outlet fittings 22, 24 to which are connected the hydraulic hoses 26, 28 to provide the motive power from a hydraulic fluid pump (not shown).

In FIG. 1, the trigger lever 16 is shown in its "clamping" position and the chuck jaws 30 (seen in FIG. 4) are wedged against the ground rod 20, holding it firmly in place so that an operator can easily position the tip of the ground rod 20 at the point where it is to be driven into the ground. In this view, the tip of the ground rod 20 is seen to have pierced the ground, and it will be appreciated that the weight of the ground rod driver itself will normally serve to start the penetration before drive action commences.

Figure 2:
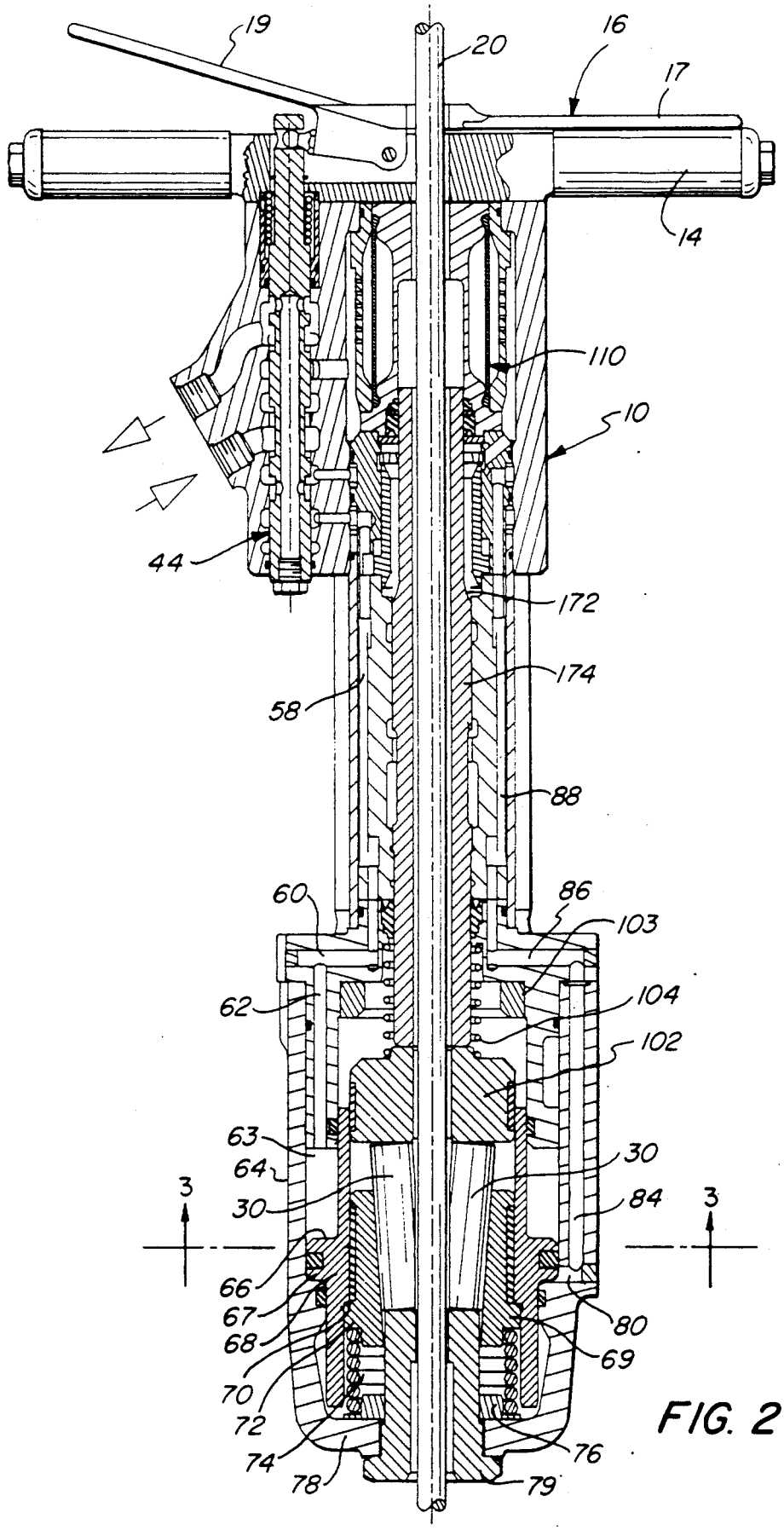
FIG. 2 is a longitudinal cross sectional view of the ground rod driver showing the components when the trigger is held in the "release" position.
Figure 2A:
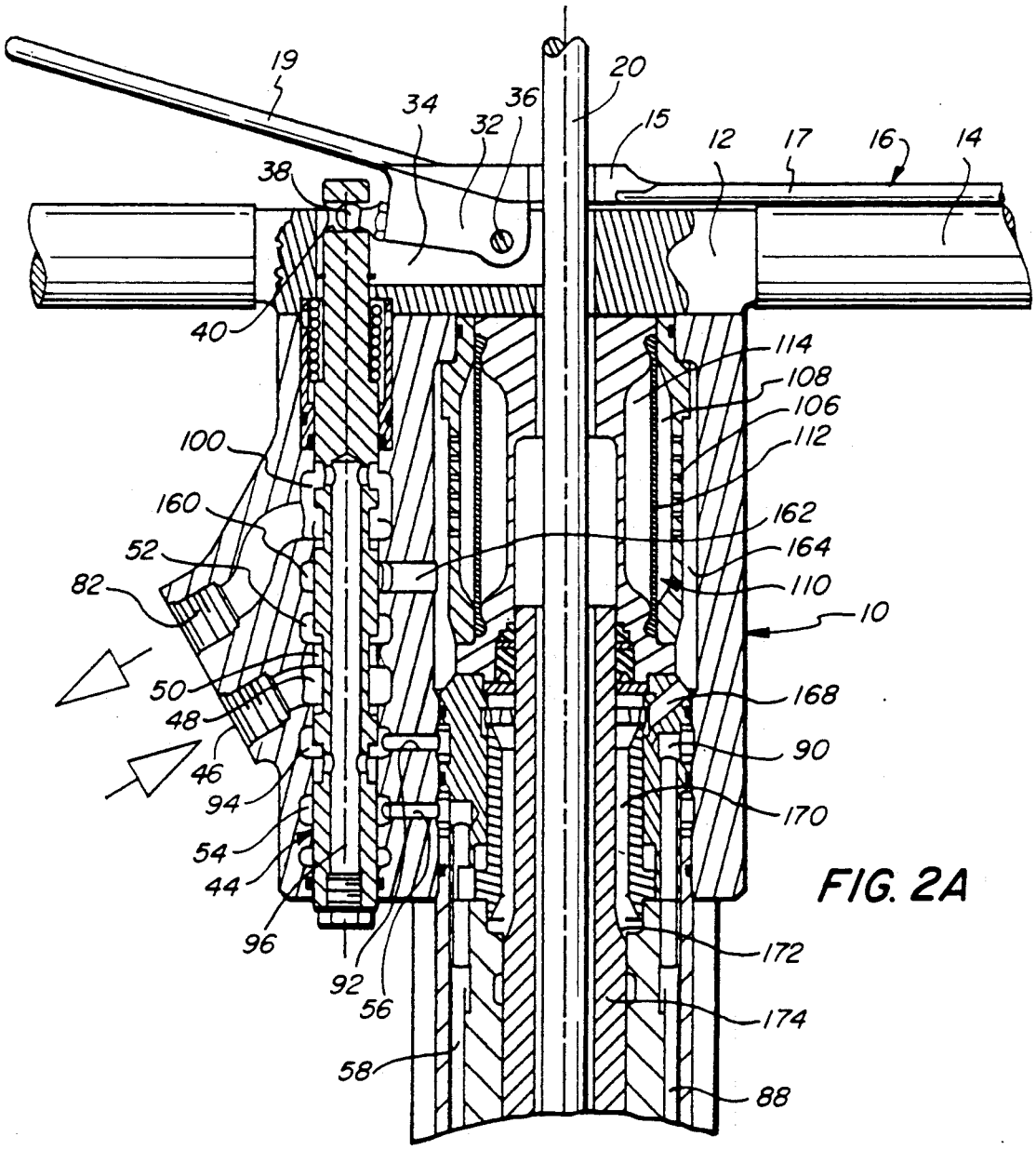
FIG. 2A is an enlarged view of the upper portion of the ground rod driver of FIG. 2.

Turning next to FIG. 2, this cross sectional view shows the ground rod driver with the trigger lever 16 in the "release" position. This is the position in the which the chuck jaws 30 release their grip on the rod 20, permitting insertion of the rod 20 into the driver and subsequently permitting the ground rod driver to be elevated to a higher point on the rod 20 to expose another section of the rod to be driven into the ground. Moreover, in this position, after the rod 20 has been driven into the ground so deeply as is desired, the ground rod driver may be lifted to clear the upper end of the rod 20.

As seen, the center section 15 of the trigger lever 16 has a boss 32 which extends downwardly into a recess 34 in the top cap 12, and a pivot pin 36 extends therethrough. The lever projection 38 extends into a passage 40 in the slide valve generally designated by the numeral 44 and depressing the lever arm 17 of the trigger lever 16 lifts the slide valve 44 to its uppermost position.

In this position, high pressure hydraulic fluid enters the inlet port 46, flows through the annular chamber 48 to the annular passage 50 which, with the slide valve 44 in its uppermost position, communicates with the annular chamber 52. From the annular chamber 52, the hydraulic fluid travels through a passage (not shown) to the annular chamber 54. From the chamber 54, the hydraulic fluid flows successively through the interconnecting passages 56, 58, 60 and 62 to the annular chamber 63 within the chuck cylinder 64, where it exerts pressure on the upper face 66 of the ring 67 of the chuck piston 68 to drive it downwardly. The chuck piston 68 has an inner shoulder 70 which bears against the circumferential shoulder 72 on the chuck 69 so that it is driven downwardly, overcoming the upward force of the spring 74 and compressing it against the spring guide washer 76 which is supported on the bottom wall 78 of the cylinder 64. Downward movement of the jaws 30 is limited by the guide nut 79 in the bottom of the housing 10.

In this position, the chuck piston 68 and chuck 69 have bottomed in the chuck cylinder 64, and the hydraulic fluid which formerly filled the chamber 63 in the chuck cylinder 64 below the piston ring 67 has been expelled through port 80. In this mode of operation, the expelled hydraulic fluid is channeled to the low pressure return port 82. This is accomplished as follows: the hydraulic fluid expelled through port 80 flows upwardly successively through the interconnecting passages 84, 86 and 88, to the annular chamber 90.

From annular chamber 90, it flows through the passage 92 which, in this position of the slide valve 44, connects through the annular chamber 94 to the internal passage 96 of the slide valve 44. The hydraulic fluid then flows upwardly in the passage 96 to the annular chamber 100, from which it exits the unit through the return port 82.

In the release mode illustrated in FIG. 2, the reciprocating piston 174 is kept from functioning by pressurizing both its normal low pressure and high pressure circuits. High pressure fluid flows through inlet port 46 to the passages 56 and 58 as previously described to enter the annular cavity 210 around the flanged end of the automatic valve 132. This cavity 210 must be at low pressure in order for the piston 174 to initiate automatic reciprocation. The high pressure circuit remains pressurized through its communication with the chamber 63, the passage 124, the passages 62, 60, 58, 168, the chamber 164, and the passage 162 which is blocked by the valve spool 44.

Without a differential in pressure, the piston 174 cannot reciprocate. As will be appreciated, the accumulator diaphragm 112 compresses to balance the hydraulic pressure and the nitrogen gas pressure.

Figure 3:
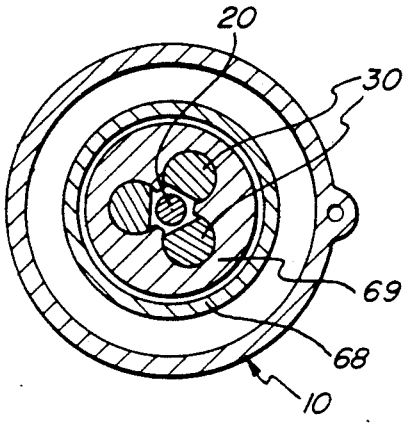
FIG. 3 is a transverse cross sectional view of the chuck along the line 3—3 of FIG. 2.

FIG. 3 is a cross sectional view showing the chuck jaws 30 after the chuck piston 68 has driven the chuck 69 fully downwardly to compress the spring 74. In this position, it will be noted that the chuck jaws 30 have released their grip on ground rod 20.

Figure 4:
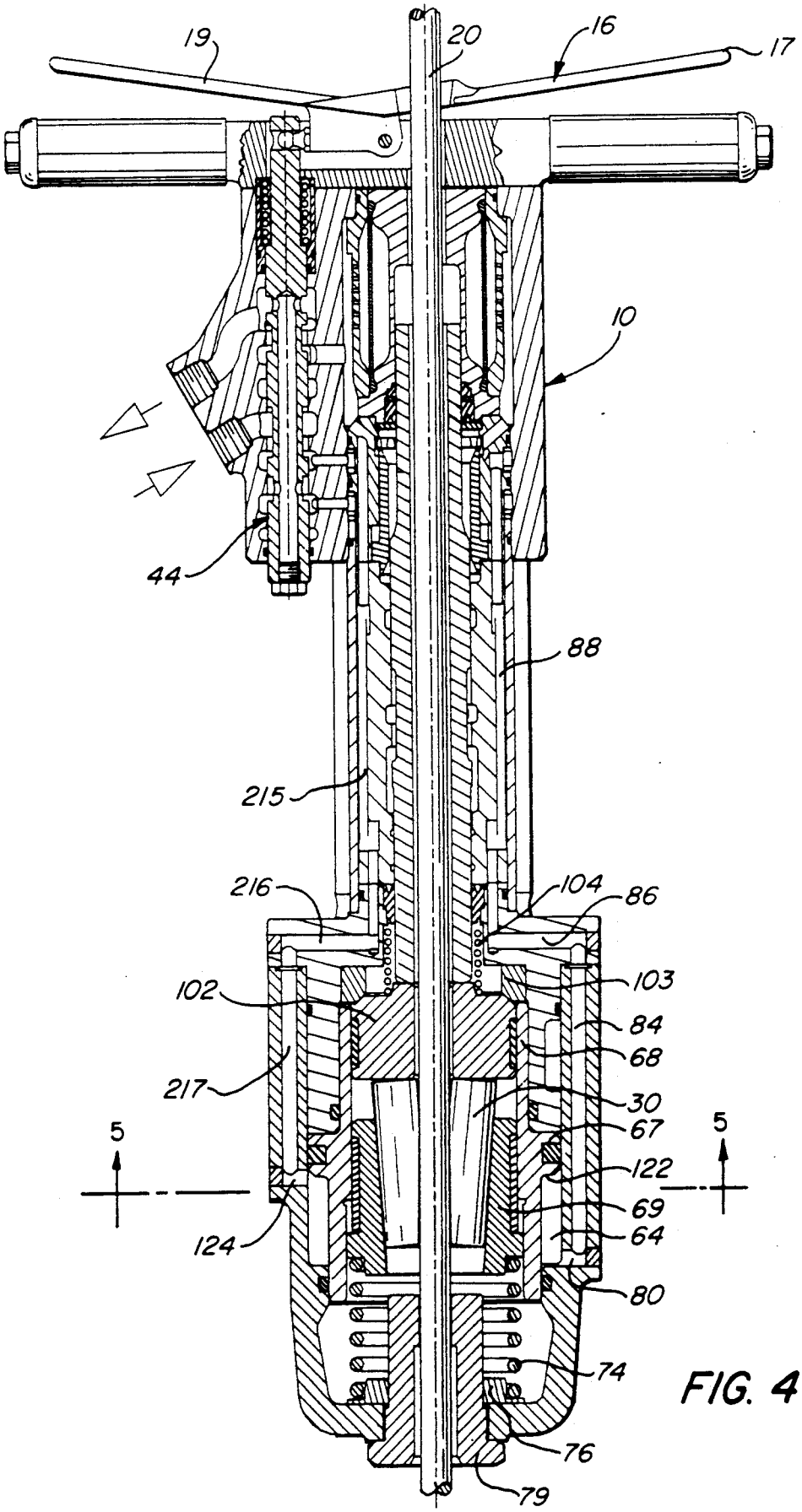
FIG. 4 is a longitudinal cross sectional view of the ground rod driver showing the components when the trigger is held in the "clamp" position.
Figure 4A:
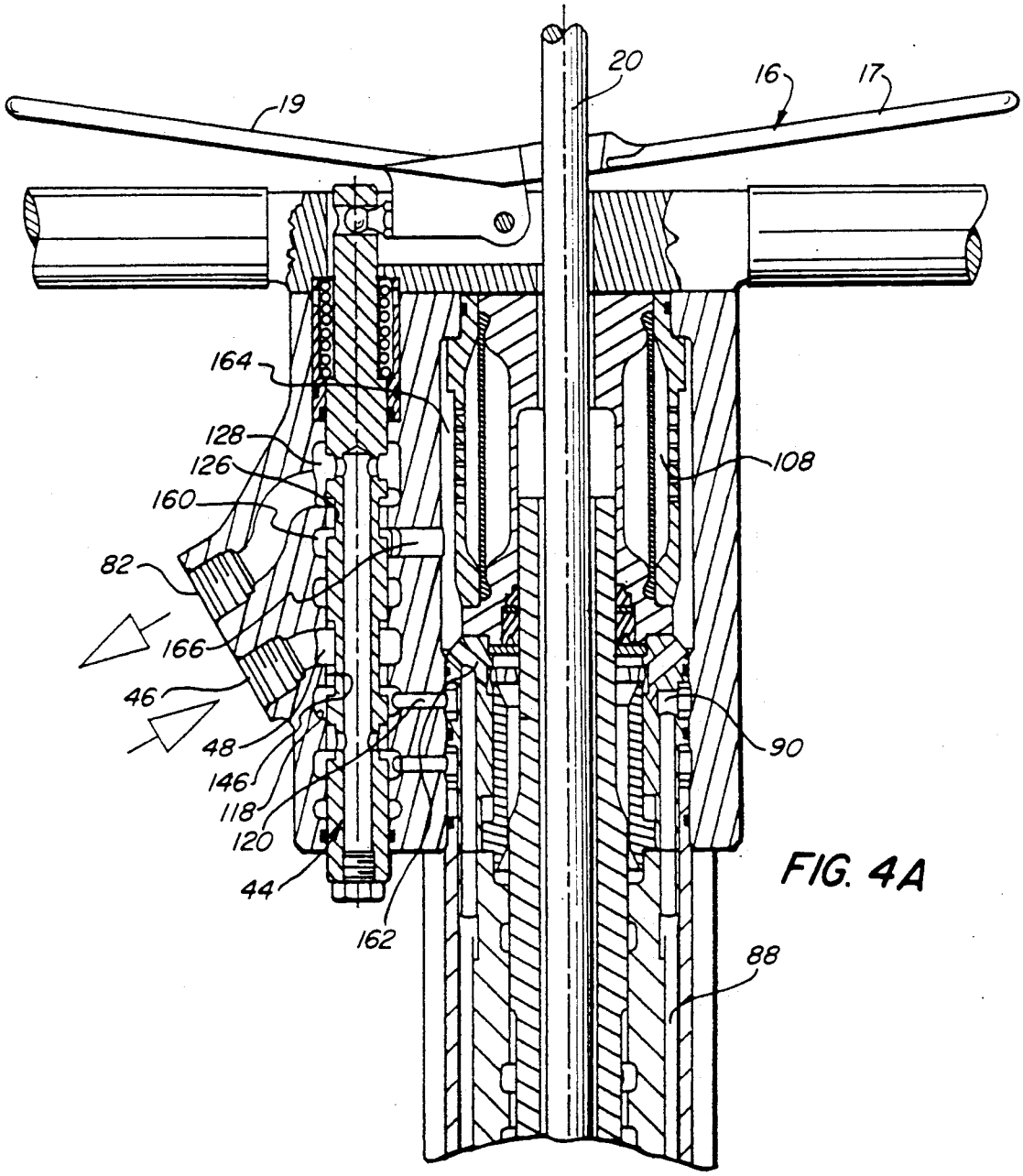
FIG. 4A is an enlarged view of the upper portion of the ground rod driver of FIG. 4.

Turning now to FIG. 4 this illustrates the operation of the ground rod driver when the trigger lever 16 is in the "clamp" position, i.e., both arms 17 and 19 extend upwardly. In this mode, the slide valve 44 rests in its intermediate position, and the effect is to reverse the paths of inflow to outflow from those which took place through the right side and left side communicating passages in the "release" position described with respect to FIG. 2. With the slide valve 44 in this intermediate position, an annular passage 116 is opened just below the annular chamber 48. This serves to channel hydraulic fluid between the annular chamber 48 and the annular chamber 118.

High pressure hydraulic fluid entering inlet port 46, thus flows into the annular chamber 48, through the annular passage 116 and into the annular chamber 118, from which it flows through the passage 120 to the annular chamber 90. From the annular chamber 90, the hydraulic fluid flows down the passage 88 and the interconnecting passages 86 and 84. After exiting at the port 80, the fluid floods the bottom of chuck cylinder 64, exerting upward pressure on bottom face 122 of the chuck piston ring 67. This pressure forces the chuck piston 68 upwardly to its extreme retracted position, in which it opens the passage 124, and thereby permits hydraulic fluid to flow through the passage 124 and then, in sequence, through passages 217, 216 and 215.

From the passage 215, the hydraulic fluid flows through the passages 162 into the annular chamber 164, and it exits the chamber 164 through the passage 166 to enter the annular chamber 160 of the slide valve 44. In this position of the slide valve 44, the annular passage 126 is open and it effects communication between the annular chamber 160 and the annular chamber 128. Pressurized hydraulic fluid flows from the annular chamber 160 through the annular passage 126 into the annular chamber 128, and it exits the ground rod driver through the return port 82 which is connected to the hydraulic return line 28 which typically discharges to a sump (not shown) at atmospheric pressure. With this valve mode, the hydraulic fluid stored under pressure in the outer chamber 108 of the accumulator 110 also communicates through the passage 166 with the chamber 160 and thus is also dumped.

The previously noted upward movement of the chuck piston 68 has also eliminated the downward force on the chuck shoulder 72 formerly transmitted through the chuck piston shoulder 70. This permits the spring 74 to expand and push the chuck 69 upwardly. This forces the chuck jaws 30 upwardly against the anvil 102, which, in turn, is pushed upwardly against the spring 104 and compresses it until the anvil abuts the anvil stop 103. The converging angle of the several lobes of the bore of the chuck 69 serves to wedge the jaws 30 into the lobes of the bore of the chuck 69 and firmly clamp them about the ground rod 20.

Figure 5:
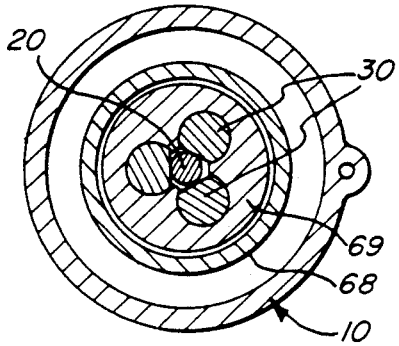
FIG. 5 is a cross sectional view of the chuck along the line 5—5 of FIG. 4.

FIG. 5 is a cross sectional view through the chuck 69 which illustrates the clamping action of the jaws 30 about the ground rod 20 in the "clamp" position.

Figure 6:
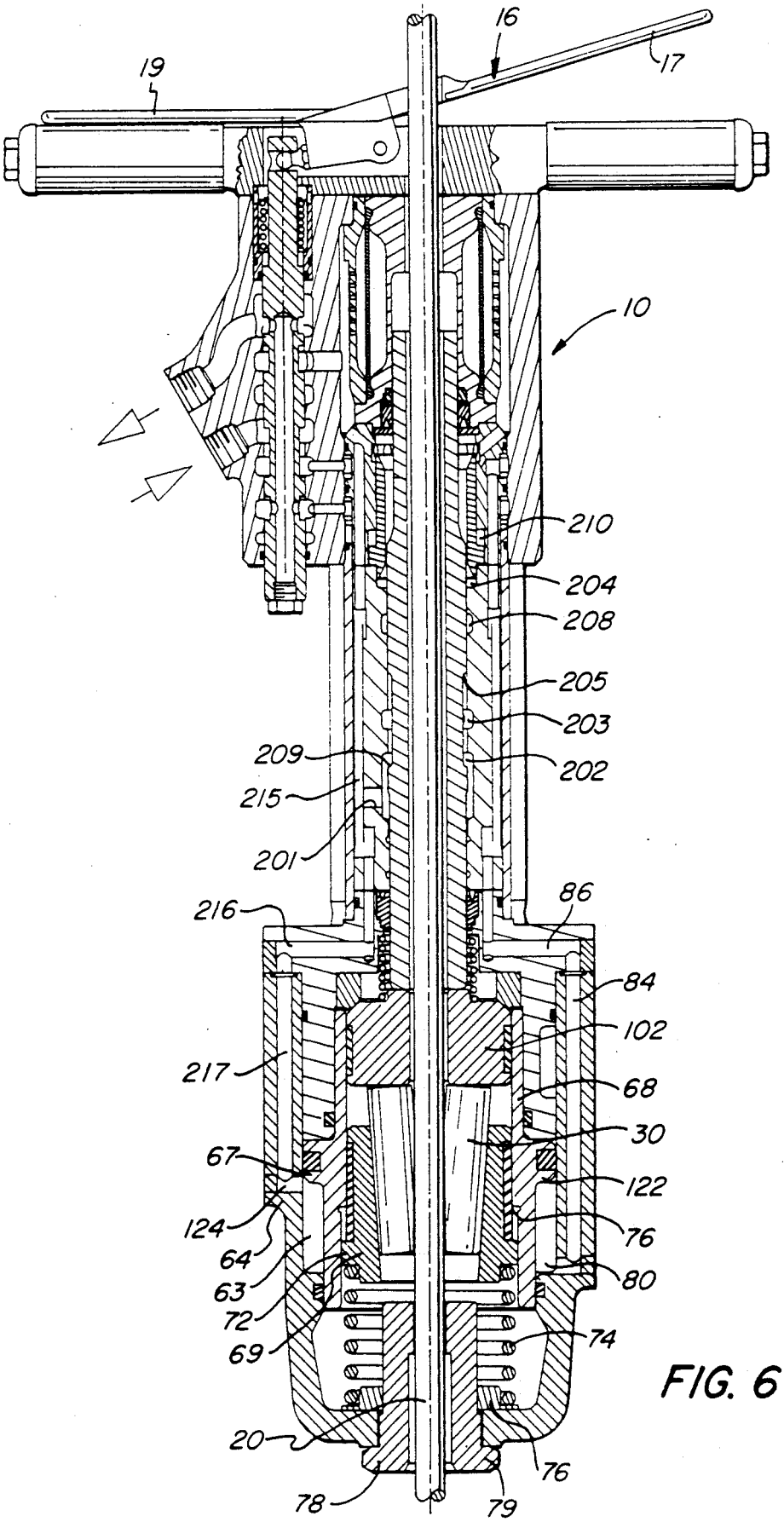
FIG. 6 is a longitudinal cross sectional view of the ground rod driver showing the components when the trigger is held in the "drive" position.
Figure 6A:
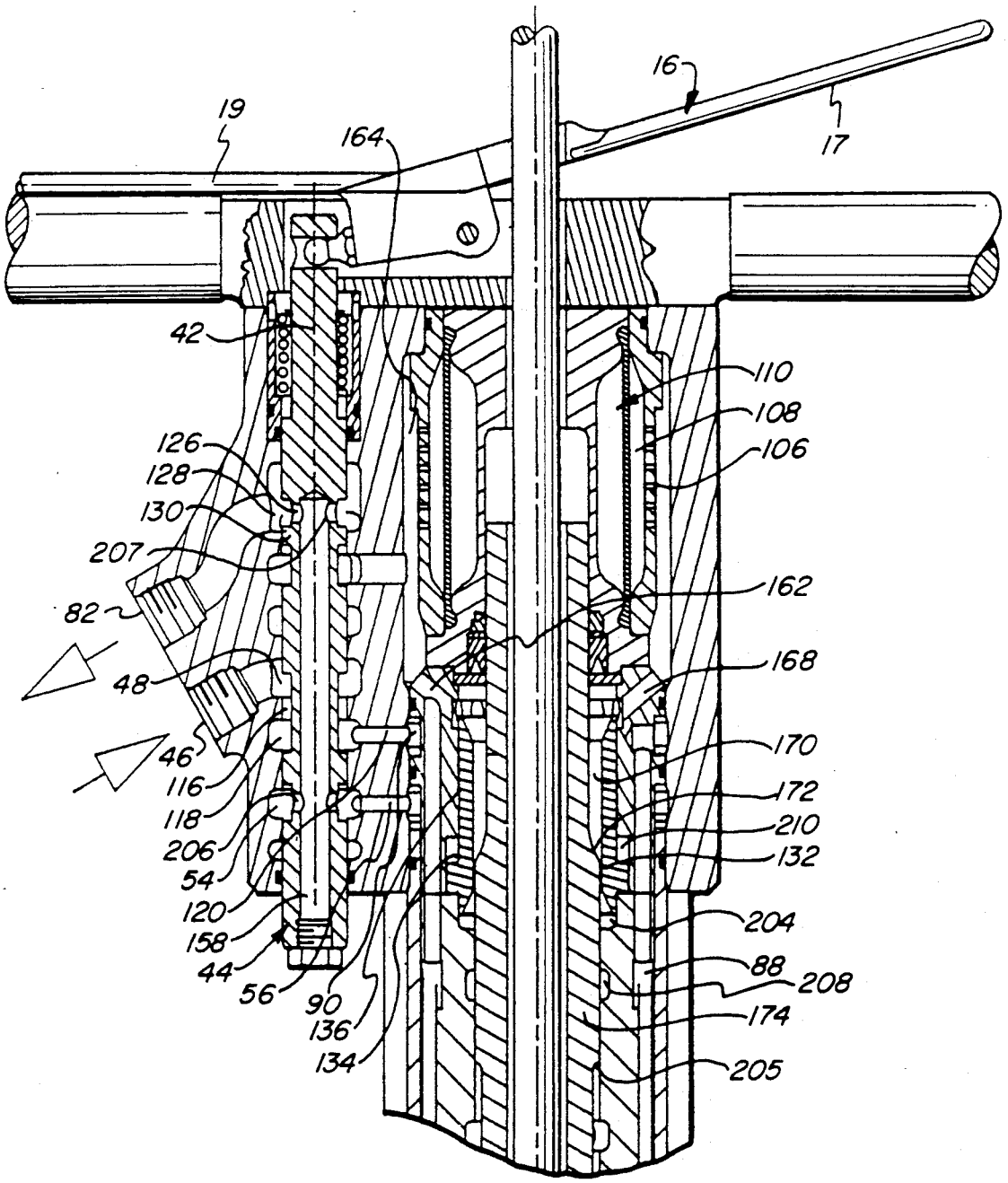
FIG. 6A is an enlarged view of the upper portion of the ground rod driver of FIG. 6.

FIG. 6 is a cross sectional view of the ground rod driver illustrating the operation when the trigger lever 16 is held in the "drive" position, by moving the arm 19 downwardly. In this position, the slide valve 44 is pushed downwardly. As a result, the annular shoulder 130 of the valve 44 seals the annular chamber 126 so that the passage 86 cannot communicate through the chamber 126 with the annular chamber 128 and thence with the return port 82.

The resulting flow of hydraulic fluid is as follows. The high pressure hydraulic fluid enters through the port 46, flows through the annular chamber 48 and thence through the annular passage 116 to the annular chamber 118. From the annular chamber 118, the fluid flows through the passage 120 to the annular chamber 90, thence down the passage 88 through the passage 86 to the passage 84. It then flows through the passage 80 to the chamber 63 of the cylinder 64 below the piston ring 67. After it floods the cylinder chamber 63, the hydraulic fluid exerts upward pressure on the bottom face 122 of the chuck piston ring 67 forcing the chuck piston 68 upwardly to its stop position. This raises the shoulder 76 of chuck piston 68 from the shoulder 72 of the chuck 69 and permits the spring 74 to expand and force the chuck 69 upwardly, pressing the chuck jaws 30 against the anvil 102 and wedging the jaws 30 into the chuck 69 to firmly grip the ground rod 20.

The upward movement of the chuck piston 68 opens the passage 124, permitting the hydraulic fluid to flow through the passage 124 to the passage 217, and thence through the passage 216 to the passage 215. From the passage 58, the fluid flows through the passages 162 and it flows in two directions: upwardly into the annular chamber 164, and downwardly through the orifices 162 into the cylinder 170. The fluid which fills the cylinder 170 exerts downward pressure on the shoulder 172 of the piston 174 which drives the piston 174 downwardly against the anvil 102. Meanwhile, fluid flows from than annular chamber 164 through the multiple orifices 106, filling the outer annular chamber 108 of the accumulator 110.

Because the jaws 30 are already wedged against the ground rod 20, the impact of the piston 174 on the anvil 102 drives those jaws 30 downwardly, and this drives the chuck 69 and the ground rod 20 downwardly, and causes the chuck 69 to compress the spring 74. At this point, the automatic valve 132 commences operation and effects repetitive drive strokes so long as the trigger lever 16 is held in the "drive" position.

Initiation of reciprocation always starts with the piston 174 in the lowermost position as shown in FIG. 6. With equal pressure in both the high and low pressure circuits, either all high as in the release position, or all low as in the clamp position, the differential in area between the upper and lower piston diameters causes the piston 174 to descend to its lowermost position.

The upward movement of the chuck piston 68 opens the passage 124, permitting the hydraulic fluid to flow through the passage 124 to the passage 217, and thence through the passage 216 to the passage 215. From the passage 215, the fluid flows in two directions: (i) upwardly through passage 162 into the annular chamber 164, and (ii) through the passage 201 to the annular chamber 202. From the annular chamber 202, fluid flows upwardly to the annular chamber 203 to act upon push pins 138 as described with respect to FIG. 7. The resulting force applied to the push pins 138 causes the automatic valve 132 to move upwardly, blocking the pressure ports 162, 168 and opening the annular chambers 170, 204 to the low pressure passages 58, 56, 206, 158, 128 and the outlet 82. The pressurized fluid entering the passage 201 to annulus 202 acts upon the shoulder 205 of the piston 174 to lift the piston 174 and expel the fluid in chamber 170 through aforementioned passages. The combined resistance to flow provided by the ports 206, passage 158, and ports 207 acts as an orifice to resist outward fluid flow so that the piston 174 ascends slowly. The resulting excess pressurized inlet flow is diverted through the passages 162, 168 to annular chamber 164 through multiple orifices 106 compressing the gas in the chamber 114 by the diaphragm 112. As can be seen, the accumulator 110 is an annular, pressurized hydraulic fluid energy storage device consisting of a diaphragm 112 separating an outer hydraulic fluid chamber 108 and an inner nitrogen filled chamber 114. The primary function of the accumulator 110 is to store hydraulic fluid under high pressure to augment incoming fluid during the power stroke or impact stroke, of the piston 174.

A secondary function of the accumulator 110 is to serve as a surge suppressor to absorb pressure spikes and fluctuations in the high pressure circuit.

Once the piston 174 has risen so that (i) the shoulder 205 uncovers the annular groove 208 (which is connected by passages (not shown) to the outlet 82, (ii) the shoulder 209 blocks communication with the pressurized cavity 202, and (iii) the push pins 138 are now connected to the low pressure circuit. The push pins 140 act upon the upper surface 150 of the flange 152 of the automatic valve 132 to move the automatic valve 132 to its lowest position as shown. In this position, communication of the chamber 170 with low pressure cavity 210 is blocked by the lower edge of the automatic valve 132, and there is communication with incoming fluid by the passage 158 and the previously described flow path of pressurized fluid in the accumulator 110 through the port 169 is opened by the upper edge of the automatic valve 134. Since the area represented by the shoulder 172 of the piston 174 is greater than the area provided by the shoulder 205, the piston 174 rapidly accelerates downwardly until it impacts upon the anvil 102.

Because the jaws 30 are already wedged against the ground rod 20, the impact of the piston 170 on the anvil 120 drives those jaws 30 downwardly, tightening their grip on the ground rod 20 and simultaneously driving the ground rod 20 into the ground.

Figure 7:
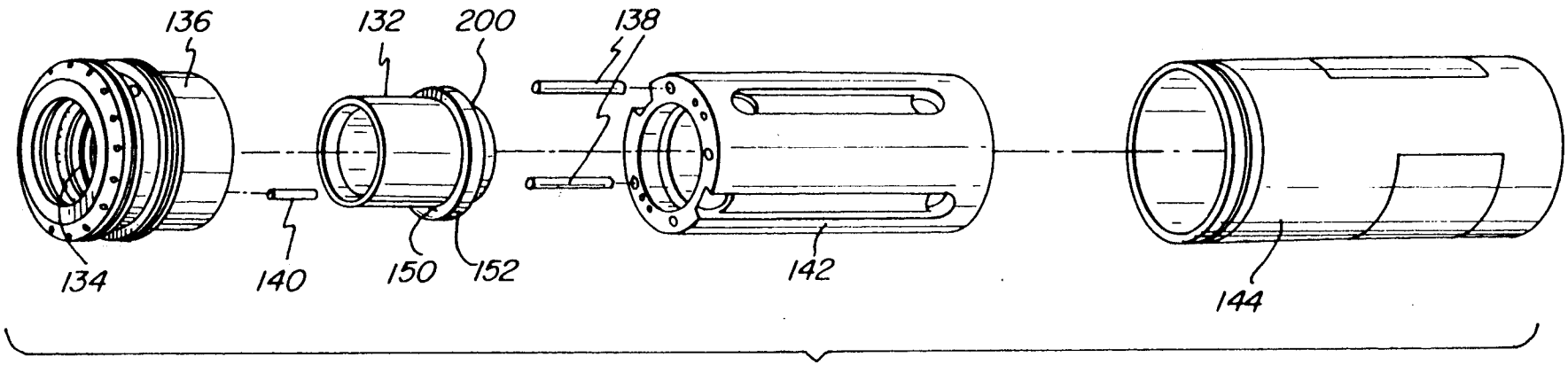
FIG. 7 is an exploded view of the automatic valve assembly which effects repetitive impacts upon the anvil when the trigger is held in the "drive" position.

FIG. 7 is an exploded view of the reciprocating assembly of the automatic valve 132 which, in combination with the drive piston 174, plays the central role in effecting the reciprocation of the piston 174. The automatic valve body 136 houses two push pins 140, only one of which is shown, and it has an internal bore 134 (shown in FIG. 6) in which the automatic valve 132 is seated. The two push pins 140 exert downward pressure on the upper surface 150 of the flange 152, while four push pins 138 (only two of which are shown) housed within the flow sleeve 142, exert upward pressure on the lower surface of the flange 152. In the "drive" mode, the push pins 140 are always acted upon by high pressure hydraulic fluid. However, the push pins 138 alternately communicate with the high pressure and low pressure sides of the hydraulic system, as valved by the flow sleeve 142 which is sealed within the flow sleeve tube 144. The valve action depends upon the position of the drive piston 174. An O-ring seal 146 is provided between the sleeve 142 and the sleeve tube 144.

In the attached drawings, it should be noted that the housing 10 of the ground rod driver does not contact the ground; some prior art ground rod drivers typically require contact with the ground at some point in their operation, such as, for example, to effect the release of the chuck jaws from the rod. Therefore, they must generally be held in a substantially vertical position, and this is not always practical, such as, for example, when rock covered terrain precludes effective ground contact, and requires that the rod 20 be driven at whatever angle chinks in the rock cover permit insertion of the rod. The ground rod driver of the present invention requires no ground contact of the ground rod driver and it permits a rod 20 to be driven at any angle. Thus, it is also suitable for driving various other elements such as the anchoring means or other devices to which guy wires are to be attached. As will be appreciated, anchoring rods must generally be driven into the ground at angles substantially displaced from the vertical.

Having thus described the invention, what is claimed is:

1. In a ground rod driver, the combination comprising:

(a) a housing having upper and lower ends, a top cap at the upper end, and inlets and outlets for hydraulic fluid;

(b) a chuck assembly in said housing adjacent said lower end including a chuck having a central bore with a multiplicity of circumferentially spaced guide surfaces and a multiplicity of chuck jaws having planar inner faces and outer surfaces slidably seated on said guide surfaces in said central bore of said chuck, said chuck jaws being spaced apart and said inner faces defining a passage therebetween, said guide surfaces of said chuck bore and said outer surfaces of said jaws having cooperating downwardly inward tapers to a smaller cross section to provide a wedging action upon relative movement of said jaws downwardly into said bore;

(c) means for effecting relative movement of said jaws and chuck bore, relative movement inwardly of said jaws into said chuck bore effecting clamping of a ground rod extending through said jaws and relative movement of said jaws outwardly of said chuck bore releasing the ground rod;

(d) an anvil in said housing above said chuck assembly and abutting said chuck jaws;

(e) a drive piston assembly adjacent the upper end of said housing and including a reciprocatable hollow drive piston for impacting upon said anvil, said top cap, housing, drive piston assembly, anvil, and chuck having aligned passages therein through which a ground rod may extend;

(f) valve means in said housing for effecting reciprocation of said drive piston to impact upon said anvil; and (g) hydraulic fluid circuit means in said housing communicating with said drive piston assembly and said chuck movement means, said hydraulic fluid circuit means including a hydraulic circuit to move said chuck jaws outwardly of said bore into a rod releasing position and inwardly of said bore into a rod clamping position, whereby a ground rod may be passed through said aligned passages and said chuck jaw movement means may be activated to clamp the ground rod, said drive piston may thereafter be reciprocated to impact upon said anvil and thereby said chuck jaws to grip and drive the ground rod into the ground while it remains continuously and firmly gripped in said chuck jaws.

2. The ground rod driver in accordance with claim 1 wherein said movement means includes a compressible spring in said housing below said chuck biasing said chuck upwardly about said chuck jaws to effect initial clamping of the ground rod.

3. The ground rod driver in accordance with claim 2 wherein the impact of said drive piston upon said anvil and thereby upon said chuck jaws exerts a force driving said chuck jaws into said bore of said chuck.

4. The ground rod driver in accordance with claim 1 wherein said chuck bore includes a multiplicity of axially extending angled recesses spaced thereabout and said jaws are cooperatively configured to slidably seat in said recesses.

5. The ground rod driver in accordance with claim 4 wherein said recesses are of arcuate cross section about a center passage, and the cross section of said bore is generally trilobal.

6. The ground rod driver in accordance with claim 5 wherein the cross section of said jaws is substantially that of a truncated circle with the chordal surface providing a substantially planar clamping surface.

7. The ground rod driver in accordance with claim 1 wherein there is included a trigger member pivotably mounted on said housing which is manipulatable among multiple positions to actuate said chuck jaw movement means to clamping and releasing positions and to actuate said drive piston assembly.

8. The ground rod driver in accordance with claim 7 wherein there is included in said housing a slide valve movable by said trigger member between clamping, releasing and drive positions controlling said hydraulic fluid circuits means in said driver.

9. In a rod driver, the combination comprising:

(a) a housing having upper and lower ends, a top cap at the upper end, and inlets and outlets for hydraulic fluid;

(b) a chuck assembly in said housing adjacent said lower end including a chuck having a central bore and a multiplicity of chuck jaws having inner faces and outer surfaces slidably seated in said central bore of said chuck, said chuck jaws being spaced apart and said inner faces defining a passage therebetween, said chuck bore and said outer surfaces of said jaws having a cooperating downwardly inward tapers to a smaller cross section to provide a wedging action upon relative movement of said jaws downwardly into said bore;

(c) means for effecting relative movement of said jaws and chuck bore, relative movement inwardly of said jaws into said chuck bore effecting clamping of a ground rod extending through said jaws and relative movement of said jaws outwardly of said chuck bore releasing the ground rod, said movement including a compressible spring in said housing biasing said chuck upwardly about said chuck jaws to effect initial clamping of the ground rod, said movement means also including a hydraulically actuated chuck piston to move said chuck downwardly against the biasing pressure of said spring and frictional clamping pressure between said chuck and jaws to move said chuck jaws outwardly of said bore therein;

(d) an anvil in said housing above said chuck assembly and abutting said chuck jaws;

(e) a drive piston assembly adjacent the upper end of said housing and including a reciprocatable hollow drive piston for impacting upon said anvil, said top cap, housing, drive piston assembly, anvil, and chuck having aligned passages therein through which a ground rod may extend;

(f) valve means in said housing for effecting reciprocation of said drive piston to impact upon said anvil; and (g) hydraulic fluid circuit means in said housing communicating with said drive piston assembly and said chuck movement means, said hydraulic fluid circuit means including a hydraulic circuit to move said chuck jaws outwardly of said bore into a rod releasing position and inwardly of said bore into a rod clamping position, whereby a ground rod may be passed through said aligned passages and said chuck jaw movement means may be activated to clamp the ground rod, said drive piston may thereafter be reciprocated to impact upon said anvil and thereby said chuck jaws to grip and drive the ground rod into the ground while it remains continuously and firmly gripped in said chuck jaws.

10. The ground rod driver in accordance with claim 9 wherein said housing includes a stationary guide nut at its lower end against which said chuck jaws abut to limit downward movement thereof with said chuck jaws.

11. The ground rod driver in accordance with claim 9 wherein said chuck piston is movable upwardly to allow said compression spring to bias said chuck upwardly about said chuck jaws to effect initial clamping action.

12. The ground rod driver in accordance with claim 11 wherein said anvil is movable upwardly in said housing with said chuck jaws and there is included a stop to limit upward movement of said anvil, said chuck jaws and anvil being movable upwardly with said chuck until said anvil abuts said stop and further upward movement of said chuck causes said chuck jaws to move inwardly of said chuck bore as said chuck moves upwardly thereabout.

13. The ground rod driver in accordance with claim 9 wherein said chuck piston is of generally annular cross section with an external shoulder upon which the hydraulic fluid in said hydraulic fluid circuit means acts and with a shoulder extending about its inner periphery which is engageable with a circumferential shoulder on said chuck to effect said downward movement of said chuck.

14. The ground rod driver in accordance with claim 13 wherein said chuck has a circumferential collar on its outer periphery providing said circumferential shoulder and said compression spring bears against the lower surface of said circumferential collar on said chuck.

15. The ground rod driver in accordance with claim 13 wherein the portion of said housing adjacent its lower end provides a cylinder in which said chuck piston is movable.

16. In a ground rod driver, the combination comprising:

(a) a housing having upper and lower ends, a top cap at the upper end, and inlets and outlets for hydraulic fluid;

(b) a chuck assembly in said housing adjacent said lower end including a chuck having a central bore and a multiplicity of chuck jaws having inner faces and outer surfaces slidably seated in said central bore of said chuck, said chuck jaws being spaced apart faces and said inner faces defining a passage therebetween, said chuck bore and said outer surfaces of said jaws having cooperating downwardly inward tapers to a smaller cross section to provide a wedging action upon relative movement of said jaws downwardly into said bore, said chuck bore having a multiplicity of axially extending recesses providing said inwardly tapering configuration and said jaws being cooperatively configured to slidably seat in said recesses;

(c) means for effecting relative movement of said jaws and said chuck bore, relative movement inwardly of said jaws into said chuck bore effecting clamping of a ground rod extending through said jaws and relative movement of said jaws outwardly of said chuck bore releasing the ground rod, said movement means including a compressible spring in said housing below said chuck biasing said chuck upwardly about said chuck jaws to effect initial clamping of the ground rod, said movement means also including a hydraulically actuated chuck piston to move said chuck downwardly against the biasing pressure of said spring to move said chuck jaws outwardly of said bore therein, said chuck piston being movable upwardly to allow said compression spring to bias said chuck upwardly about said chuck jaws to effect initial clamping action;

(d) an anvil in said housing above said clutch assembly and abutting said chuck jaws;

(e) a drive piston assembly adjacent the upper end of said housing and including a reciprocatable hollow drive piston for impacting upon said anvil, said top cap, housing, drive piston assembly, anvil, and chuck having aligned passages therein through which a ground rod may extend;

(f) valve means in said housing for effecting reciprocation of said drive piston to impact upon said anvil; and (g) hydraulic fluid circuit means in said housing communicating with said drive piston assembly and said chuck movement means, said hydraulic fluid circuit means including a hydraulic circuit to move said chuck jaws outwardly of said bore into a rod releasing position and inwardly of said bore into a rod clamping position whereby a ground rod may be passed through said aligned passages and said chuck jaw movement means may be activated to clamp the ground rod, said drive piston may thereafter be reciprocated to impact upon said anvil and thereby said chuck jaws to grip and drive the ground rod into the ground while it remains continuously and firmly gripped in said chuck jaws.

17. The ground rod driver in accordance with claim 16 wherein said housing includes a stationary guide nut at its lower end against which said chuck jaws abut to limit downward movement thereof with said chuck jaws.

18. The ground rod driver in accordance with claim 16 wherein said anvil is movable upwardly in said housing with said chuck jaws and there is included a stop to limit upward movement of said anvil, said chuck jaws and anvil being movable upwardly with said chuck until said anvil abuts said stop and further upward movement of said chuck causes said chuck jaws to move inwardly of said chuck bore as said chuck moves upwardly thereabout.

19. The ground rod driver in accordance with claim 16 wherein said chuck piston is of generally annular cross section with an external shoulder upon which the hydraulic fluid in said hydraulic fluid circuit means acts and with a shoulder extending about its inner periphery which is engageable with a circumferential shoulder on said chuck to effect said downward movement of said chuck.

20. The ground rod driver in accordance with claim 19 wherein said chuck has a circumferential collar on its outer periphery providing said circumferential shoulder and said compression spring bears against the lower surface of said circumferential collar on said chuck.

21. The ground rod driver in accordance with claim 16 wherein the impact of said drive piston upon said anvil and thereby upon said chuck jaws exerts a force driving said chuck jaws into said bore of said chuck.

22. The ground rod driver in accordance with claim 16 wherein there is included a trigger member pivotably mounted on said housing which is manipulatable among multiple positions to actuate said chuck jaw movement means to clamping and releasing positions and to actuate said drive piston assembly.

23. The ground rod driver in accordance with claim 22 wherein there is included in said housing a slide valve movable by said trigger member between clamping, releasing and drive positions controlling said hydraulic fluid circuits means in said driver.

24. The ground rod driver in accordance with claim 16 wherein said chuck bore includes a multiplicity of axially extending angled recesses spaced thereabout and said jaws are cooperatively configured to slidably seat in said recesses.

25. The ground rod driver in accordance with claim 24 wherein said recesses are of arcuate cross section about a center passage, and the cross section of said bore is generally trilobal.

26. The ground rod driver in accordance with claim 25 wherein the cross section of said jaws is substantially that of a truncated circle with the chordal surface providing a substantially planar clamping surface.

* * * * *